United States Patent [19]

Knorowski et al.

[11] Patent Number: 4,497,612

[45] Date of Patent: Feb. 5, 1985

[54] STEAM TURBINE WHEEL ANTIROTATION MEANS

[75] Inventors: Victor J. Knorowski, Rexford; Daniel J. Sheflin, Schenectady, both of N.Y.

[73] Assignee: General Electric Company, Schenectady, N.Y.

[21] Appl. No.: 555,179

[22] Filed: Nov. 25, 1983

[51] Int. Cl.[3] ..... F01D 5/06

[52] U.S. Cl. ..... 416/198 A; 416/201 R

[58] Field of Search ..... 416/198 A, 199, 200 A, 416/201 R, 201 A, 204 A; 415/199.4, 199.5

[56] References Cited

U.S. PATENT DOCUMENTS

| | | | |
|---|---|---|---|
| 1,593,393 | 7/1926 | Doran | 416/198 A |
| 1,873,956 | 8/1932 | Dahlstrand | 416/198 A X |
| 3,715,176 | 2/1973 | Kerklo | 416/198 A |
| 4,029,437 | 6/1977 | Aubry et al. | 416/198 A |
| 4,330,236 | 5/1982 | Le Breton | 416/198 A |

FOREIGN PATENT DOCUMENTS

| | | | |
|---|---|---|---|
| 137896 | 3/1948 | Australia | 416/198 A |
| 510277 | 4/1952 | Belgium | 416/198 A |
| 74609 | 7/1978 | Japan | 416/198 A |

*Primary Examiner*—Everette A. Powell, Jr.

*Attorney, Agent, or Firm*—John F. Ahern; Paul Checkovich

[57] ABSTRACT

A steam turbine rotor includes a plurality of turbine wheels secured to a shaft by an interference shrink fit between each wheel and a corresponding step surface on the shaft. The step surfaces have decreasing radii over a portion of the axial length of the shaft. Each wheel incudes a hub section proximate the shaft and each hub section has a shoulder portion of greater radial dimension than the radially innermost surface of the hub section. A member or finger protrudes from one shoulder and mates with a longitudinal slot on one of the step surfaces of the shaft. Relief grooves are also provided for on the shaft and hub section.

13 Claims, 10 Drawing Figures

STEAM TURBINE WHEEL ANTIROTATION MEANS

BACKGROUND OF THE INVENTION

This invention relates generally to a safety device for a steam turbine wheel as part of a turbine rotor, and particularly, to a member or finger disposed at the bore of the wheel's hub section locking into a slot on the shaft of the rotor thereby preventing the wheel from rotating relative to the shaft when the interference shrink fit between the wheel and shaft loosens.

Some steam turbines utilize such large rotors, that the turbine wheels, which carry the turbine blades at their radially outer most portions, are not an integral part of the shaft of the rotor. The radial dimensions of such turbine rotors are on the order of seven or eight feet excluding the turbine blade dimension. It is well known in the art that such large rotors experience great amounts of stresses, due to their size and due to the quality and quantity of steam affecting their buckets. In addition to the turbine blades, each wheel includes a hub section generally disposed at its radially inward portion.

Each hub section has a bore therethrough. The wheel is secured to the shaft of the rotor by an interference shrink fit between the radially inner surface of the hub section and the corresponding surface of the shaft. During normal turbine operations, this interference fit prevents rotation of the wheel relative to the shaft.

Due to the large size of the steam turbine rotor, the initial cost of the mechanism, and the operating costs of the device, it is required that the turbine blades be maintained at a substantially fixed positions relative to the shaft. This requirement should be met during all turbine operations, including normal but non-steady state conditions such as overspeed and undesirable thermal transient periods. This requirement is of greater importance when the steam turbine rotor is acted upon by steam generated in a nuclear boiler. To insure that the turbine wheels do not rotate relative to the shaft during such turbine operations, a safety device or a redundant locking means is incorporated into the wheel, such as the bore through the hub section of the wheel.

It is recognized in this art that the wheel bore and shaft surface interface is under a great degree of stress. This stress, in combination with other stresses generated by transient thermal or other unavoidable operating conditions, has been known to cause stress corrosion cracking indications in the hub section of the wheels. The precise mechanism which produces stress corrosion cracking is not fully understood, however it is believed that if the stresses at the wheel bore are kept at a minimum and the accumulation of water, condensed from the steam, is minimized and/or eliminated in that region, the probability of a stress corrosion cracking problem developing in that wheel will be reduced if not eliminated.

One prior art device which locks each wheel to the shaft utilizes a member protruding into a slot on the shaft. However, this relatively simple locking means significantly increases the stress concentration factor in that region of the wheel bore and consequentially increases the probability of a stress corrosion cracking problem in the wheel.

OBJECTS OF THE INVENTION

It is an object of this invention to provide for a locking or antirotation means at the wheel bore/shaft surface interface which prevents rotation of the wheel relative to the shaft when the interference fit therebetween loosens.

It is an additional object of this invention to provide for a locking means at the wheel bore which minimizes the stress concentration factor in that region.

SUMMARY OF THE INVENTION

A rotor of a steam turbine, rotatably mounted within the turbine includes a multi-stepped shaft having sequentially decreasing radii along an axial segment of the shaft. Each of the steps includes a pair of circumferential grooves, an axially fore groove, and axially aft groove. A longitudinal slot extends between the aft groove and the axially aft edge of the step. At least one wheel is secured to each sequential step by an interference shrink fit between the inner radial surface of the hub section of the wheel and the step surface. At the axial end of the inner surface, each hub section has a shoulder portion having a greater radial dimension than the inner surface, and one shoulder includes at least one member protruding therefrom. The member is matingly engageable with the slot which is proximate that axial end of the hub section. The member's leading face, with respect to the direction of rotation of the shaft, is in contact with the slot's leading side wall such that the member prevents rotation of the wheel relative to the shaft if the interference fit should loosen.

In one embodiment, the member protrudes radially inward from the shoulder and is matingly engageable with the slot on the preceeding step surface. In this situation, the member is disposed at the axially fore portion of the hub. In another embodiment, the member protrudes radially inward from the shoulder located at the axially aft portion of the hub section, and hence, the member matingly engages the slot on the sequential step surface corresponding to that particular wheel. In a third embodiment, the member protrudes axially from one axial end face of the hub section and in such embodiment the member is called a "finger".

Additionally, the interfaces between the leading and trailing member or finger faces and the shoulder proximate thereto are streamlined fillets such that the stress concentration factor in that region is lower than the stress concentration factor for interfaces having simple circular fillets. An additional feature of this invention includes an outbound angular slope on the shoulder portion circumferentially beyond a discrete arcuate groove, which axially segregates the member from the shrink fit interface, between 0° and 10° as referenced the surface of the sequential step.

BRIEF DESCRIPTION OF THE DRAWINGS

The subject matter which is regarded as the invention is particularly pointed out and distinctly claimed in the concluding portion of the specification. The invention however, together with further objects and advantages thereof, may best be understood by reference to the following description taken in conjunction with the accompanying drawings in which:

DETAILED DESCRIPTION OF THE DRAWINGS

Figure 1:
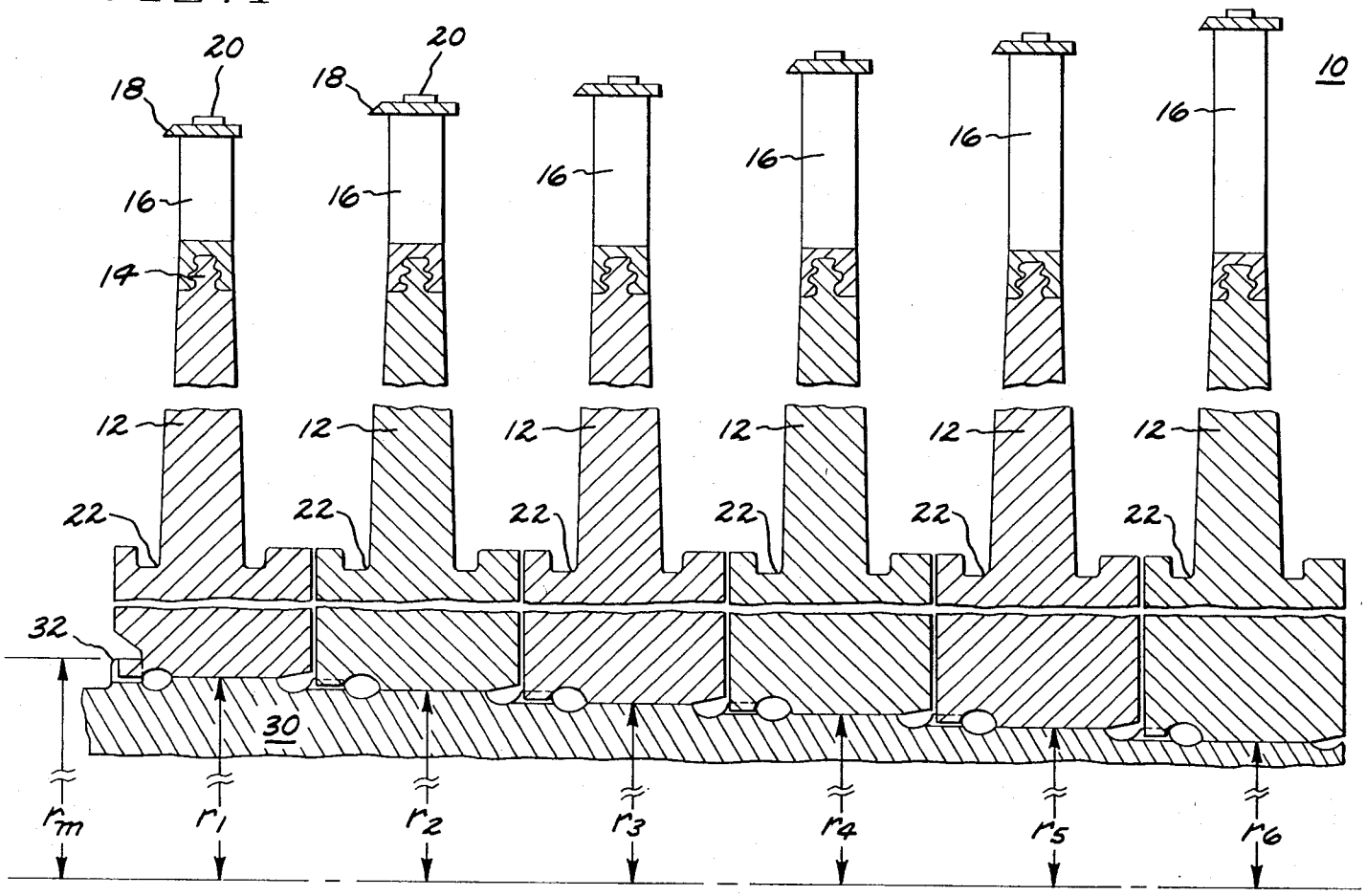
FIG. 1 illustrates a partial, cutaway longitudinal view of the steam turbine rotor.

FIG. 1 illustrates a partial, cutaway longitudinal view of a steam turbine rotor 10. A plurality of turbine wheels, each identified as item 12, carry, at their radially outermost portions one of which is designated portion 14, steam turbine blades 16. As recognized by persons of ordinary skill in the art, shrouds 18 are coupled to the radially outer portion of blades 16 by tenon pins 20. Each wheel 12 includes, at its radially inward portion, a hub section 22.

A multi-stepped shaft 30 is rotatably mounted within the steam turbine. FIG. 1 illustrates an axial segment of shaft 30 having steps of sequentially decreasing radii. Hence, $r_1$, the radial distance between the radially inner surface of the hub section of the left most wheel and the centerline axis of shaft 30, is greater than $r_2$, which in turn is greater than $r_3$. Radial dimensions $r_4$, $r_5$ and $r_6$ have sequentially decreasing radii as illustrated in FIG. 1.

It is to be recognized that although each step has a substantially uniform radius, such as $r_1$, the step may have a slightly tapered radius. The term "substantially uniform" and the designation "r", is meant to include such a tapered radius step. A radially extending, integral flange 32 is disposed proximate the sequential step having the maximum radial dimension $r_1$. Flange 32 has a radial dimension of $r_m$ in FIG. 1. Flange 32 is shown in greater detail in FIG. 2. It is to be understood that flange 32 may be part of a maximum radial portion of shaft 30 which extends to the left of FIG. 1. Also, a person of ordinary skill in the art would recognize that radial distance $r_m$ may singularly be the maximum radial portion of shaft 30.

Figure 2:
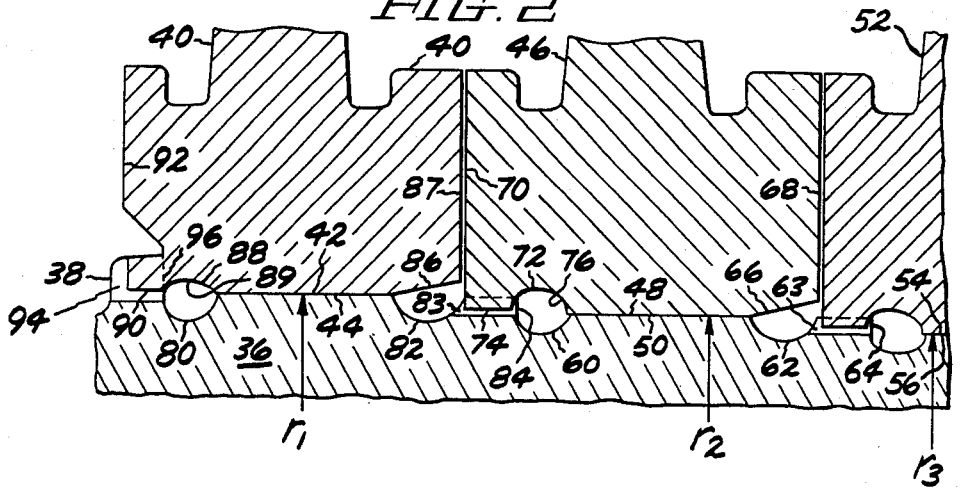
FIG. 2 is a partial, cutaway longitudinal view of the hub sections of the several turbine wheels and the adjacent portion of the shaft.

FIG. 2 illustrates a partial, cutaway longitudinal view of several hub sections and the adjacent portion of a stepped shaft 36 in addition to integral flange 38, radially protruding therefrom. Hub section 40 has a radially inner surface 42. Hub section 40 and its associated turbine wheel is secured to step surface 44 by an interference shrink fit between surface 42 and surface 44 to prevent rotation between the wheel and the shaft. Hub section 46 has its inner surface 48 in an interference fit with step surface 50 of the next succeeding step having a lesser radius, i.e., $r_2$ is less than $r_1$. The next hub section 52 is similarly secured to shaft 36 by interference fit between surface 54 and step surface 56.

Each step surface 44, 50 and 56 has a substantially uniform radius over its axial expanse. A pair of substantially parallel circumferential grooves are located on each of those surfaces. In particular, sequential step surface 50 has an axially fore groove 60, adjacent the preceeding step surface 44, and an axially aft groove 62 proximate to but axially spaced apart from the next succeeding step 56 having a lesser radius of $r_3$. Throughout this specification, the designation of axially "fore" and "aft" applied to certain items refers to the position of the item relative the radially maximum portion of the shaft, hence an "axially fore" item is closer to the maximum portion than an "axially aft" item.

A longitudinal slot axially extends between groove 62 and the axially aft edge 64 of step surface 50. The axially aft portion of step surface 50 between groove 62 and edge 64 is illustrated by a dashed line because the longitudinal view of FIG. 2 is from a plane midway through slot 63. The depth of the slot below surface 50 is less than the depth of groove 62. All step surfaces 44, 50 and 56 include axially fore and axially aft grooves on either axial side of the interference shrink fit interface between the wheel and the shaft to relieve or lessen the stress concentration factor on the surface of the shaft. In this manner, fore and aft grooves 60 and 62, respectively, are relief grooves for step surface 50 at either axial end of the interference shrink fit interface. Grooves 60 and 62 also provide an escape channel for the condensate of steam which may accumulate therein due to the thermal gradient between the steam flow path, shaft 36 and any axial thermal gradient across slot 63. All sequential step surfaces have fore and aft grooves bracketing their interference fit interfaces.

Each hub section includes a shoulder portion at each axial end of its inner surface. Hub section 46 has shoulder portion 66 at its axially aft end 68. Shoulder 66 has a greater radial dimension than the radial dimension of inner surface 48. At the hub section's axially fore end 70, shoulder 72 is generally illustrated in FIG. 2. Shoulder 72 includes at least one discrete radially inward disposed member 74. Member 74 is axially spaced away from inner surface 48 by a discrete arcuate, substantially circumferential groove 76 on shoulder 72.

The preceeding sequential step surface 44 includes an axially fore groove 80, an axially aft groove 82, and a longitudinal slot 83 extending between groove 82 and an axially aft end 84. As illustrated in FIG. 2, member 74 of hub section 46 matingly engages slot 83 of the preceeding sequential step 44.

Hub section 40 is generally similar to hub section 46 in that inner surface 42 has an axially aft shoulder 86 and an axially fore shoulder 88 adjacent axial end faces 87 and 92 respectively. However, as illustrated in FIG. 2, hub section 40 and its associated wheel are disposed on the sequential step having the largest radial dimension $r_1$, and a finger 90 axially protrudes from end face 92 proximate adjacent shoulder 88. Integral flange 38 has a longitudinal slot 94 extending to the axially aft edge 96 of the flange. It should be noted that hub section 40, having the greatest radial bore dimension, $r_1$, need not include finger 90, but could include a radially inward disposed member similar to member 74 of hub section 46. In the illustrated embodiment, finger 90 is spaced apart from the interference fit interface of surfaces 42 and 44 by a discrete arcuate, substantially circumferential groove 89 on shoulder 88.

Figure 3:
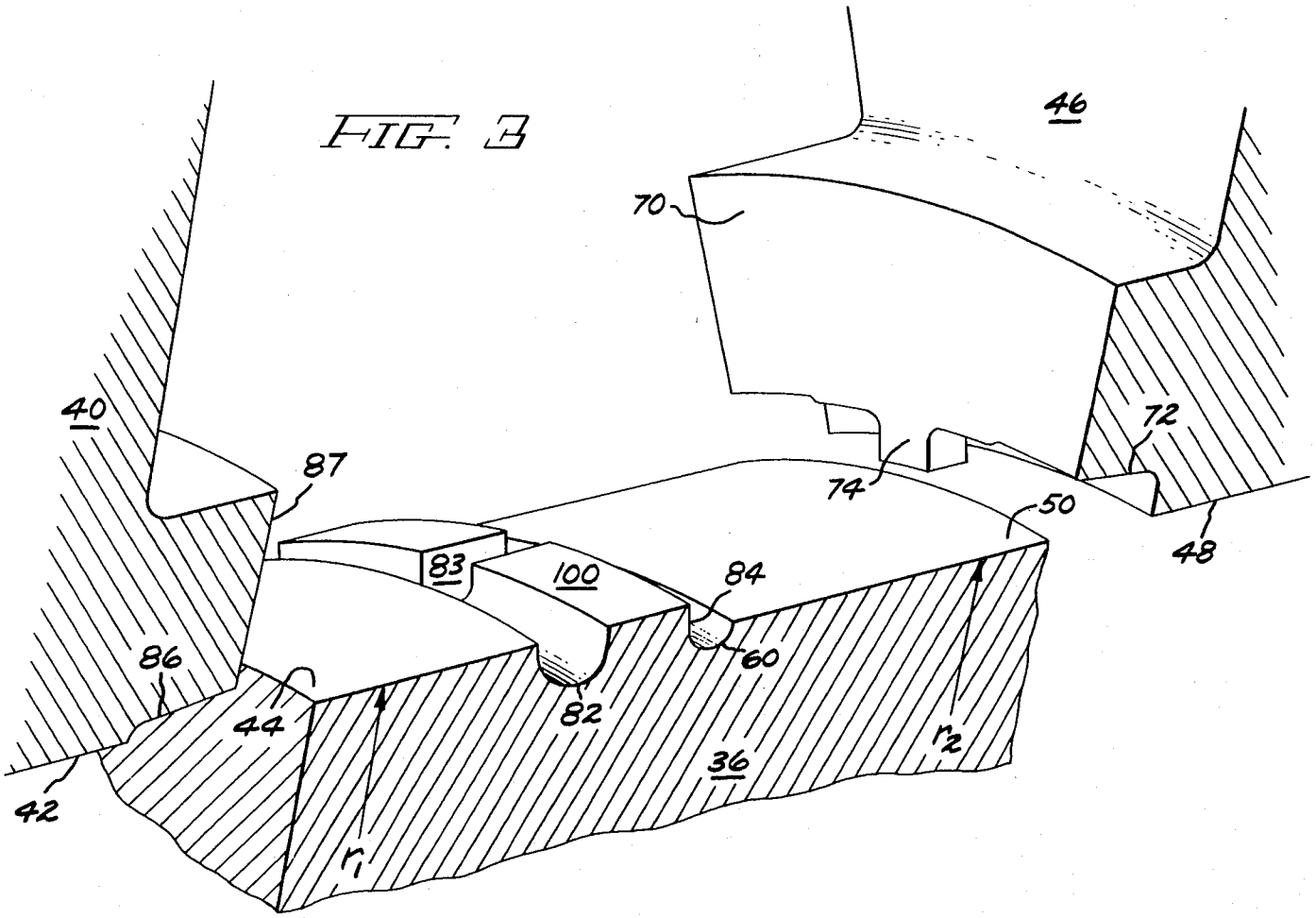
FIG. 3 is an exploded, blownup, cutaway perspective view of a pie slice of a wheel hub section with a axially fore member and the adjacent shaft portion.

FIG. 3 generally illustrates an exploded, blownup wedge or pie shaped section of hub section 46, hub section 40 and the adjacent region of shaft 36. Accordingly, similar numerals designate respective items as shown in FIG. 2. Slot 83 extends axially between groove 82 and aft edge 84 on the axially aft portion 100 of sequential step surface 44. Aft portion 100 may be either co-planar with surface 44 or may have a slightly smaller radial dimension as compared with $r_1$.

As can be seen in FIG. 3, member 74 is capable of matingly engaging slot 83 and shoulder 72 laps over or mates with aft portion 100 of surface 44.

Figure 4:
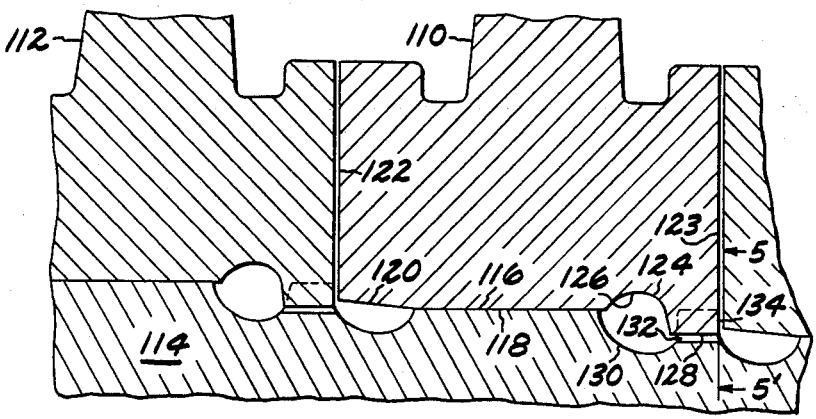
FIG. 4 illustrates a partial, cutaway longitudinal view of the wheel hub sections which include members disposed on the axially aft portions of the hub sections.

FIG. 4 generally illustrates two hub sections 110 and 112 and the adjacent shaft portion 114. The members are positioned at the axially aft end of their respective hub sections. Hub section 110 has an inner surface 116 in an interference fit with step surface 118 of shaft 114. Shoulder 120 is proximate the axially fore end 122 of hub section 110. An axially aft shoulder 124 includes a discrete arcuate groove 126 which spaces member 128 from inner surface 116. As with all sequential steps, the axially aft groove 130 of step 118 is proximate the next succeeding step and a longitudinal slot 132 extends axially between groove 130 and the axially aft edge 134 of step 118. As illustrated in FIG. 4, member 28 extends radially inward beyond inner surface 116 to matingly engage slot 132 of step surface 118 proximate axial end face 123 of hub section 110.

Figure 5:
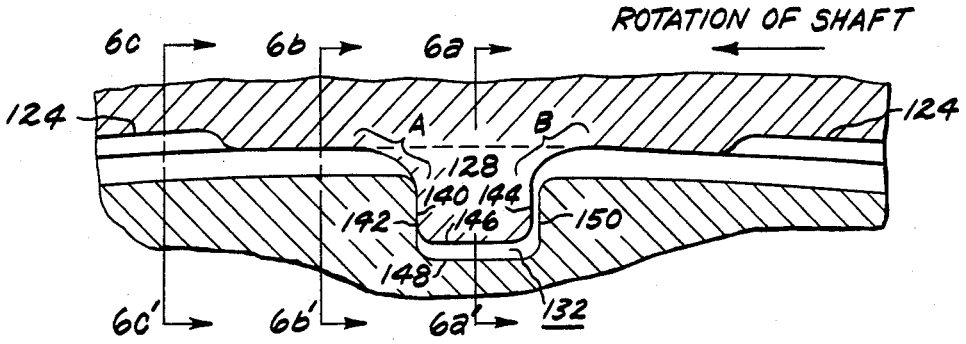
FIG. 5 illustrates the axial view of a member viewed from the perspective of section line 5—5' of FIG. 4.

FIG. 5 illustrates member 128 and the adjacent shaft region as viewed from section line 5—5′ of FIG. 4. Due to the large radial dimensions of the wheel bore and hub section, the member and regional shaft surfaces illustrated in FIG. 5 appear to be flat, when in fact they are a discrete arcuate portion of the circumference of the shaft and the inner circumference of the hub section. Assuming the direction of rotation indicated in FIG. 5, the leading face 140 of member 128 is in contact with the leading side wall 142 of slot 132. The reference to "leading" and "trailing" in this specification refer to the item's position relative to the shaft's direction of rotation. If the interference fit between the respective wheel and the shaft loosens for any reason, member 128 prevents rotation of the wheel due to the aforementioned mechanical contact.

The interface between leading face 140 and shoulder 124 is designated "A" in FIG. 5, and is a streamlined fillet. As is recognized in the art, a streamline fillet differs from a simple circular fillet in that the streamline fillet has a variable contour radius in contrast to the constant contour radius of the circular fillet. The streamlined fillet "A" minimizes the tangential stress concentration factor in the region of member 128. In a similar fashion, trailing face 144 has a streamlined fillet interface, "B" between face 144 and shoulder 124. It is recognized in the art that any protrusion or cut out on the surface of a cylinder or on the inner radial surface of a ring, increases the stress concentration factor in the region of the protrusion or the cut out. An important feature of the present invention relates to minimizing the tangential stress concentration factor in the region of the members and the slots. The presence of circumferential relief grooves on either side of the slot on the shaft surface minimizes the stress concentration factor within the shaft in the region of the slot. The streamlined fillets in regions "A" and "B" as well as the discrete arcuate grooves axially spacing the members from the inner surfaces of the hub sections reduce the stress concentration factor in the bore of the wheel hub. These relief grooves in combination with the streamlined fillets are estimated to reduce the stress concentration factor by approximately 25% as compared with other devices.

In one embodiment, the radially inner face 146 of member 128 is radially spaced apart from bottom 148 of slot 132. Also, the trailing side wall 150 of slot 132 is circumferentially spaced from the trailing face 144 of member 128. These spaces allow the wheels to be assembled without undue force and thus lessen accompanying stress which may result from assembly and also allow for the escape of condensation which may develop in the slot or on the member.

Figure 6A:
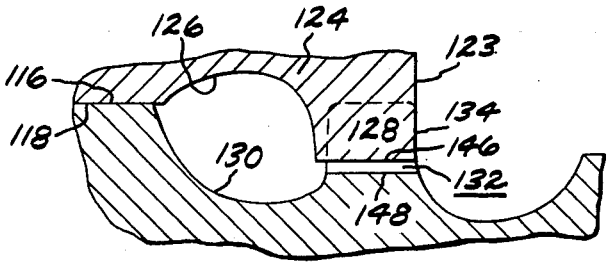
FIGS. 6*a*, 6*b* and 6*c* illustrate the views of the members and associated shaft portions as viewed respectively from the perspectives along section lines 6*a*–6*a*', 6*b*–6*b*' and 6*c*–6*c*' all of FIG. 5.
Figure 6B:
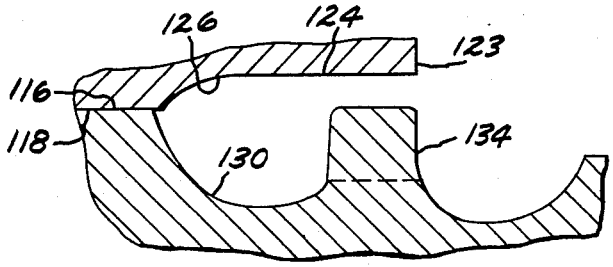
Figure 6C:
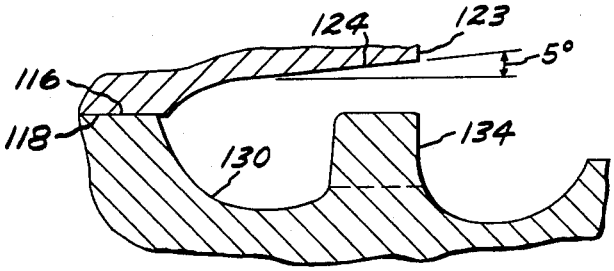

FIGS. 6*a*, 6*b*, and 6*c* show longitudinal views of the members and associated shaft portions from the perspective of section lines 6*a*–6*a*′, 6*b*–6*b*′, and 6*c*–6*c*′, respectively, in FIG. 5. Specifically, FIG. 6*a* is a view approximately midway through slot 132 from a longitudinal perspective. Clearly illustrated in FIG. 6*a* is discrete arcuate groove 126, circumferentially oriented on shoulder 124 and axially spacing member 128 from inner surface 116. Also, groove 130 on step surface 118 is proximate yet spaced apart from the axially aft edge 134 of step 118. Commonly, member 128 has one face radially aligned with axial end face 123 of the hub section. Also the axially fore members described in FIGS. 1, 2 and 3 may have one of their faces radially aligned with the axially fore end face of their respective hub sections.

FIG. 6*b* is viewed from the perspective of section line 6*b*–6*b*′ in FIG. 5. The distinctive feature in FIG. 6*b* is the slope of shoulder 124. As illustrated therein, the outbound slope, extending from surface 116 to end face 123 is approximately 0° with respect to the plane of step surface 118. In this specification, the designation "outbound" refers to a direction from the perspective of the interference fit interface towards a particular axial end face of the hub section.

The distinctive feature of FIG. 6*c* is the outbound slope of shoulder 124 which is illustrated at a 5° angle with respect to step surface 118. It is to be noted that the outbound slope of shoulder 124 circumferentially beyond the discrete arcuate groove 126 may be between 0° and 10°.

The radial space between shoulder 124 and the aft portion of step surface 118 (shown in FIG. 6*b*) in combination with the outbound slope of shoulder 124 circumferentially beyond the arcuate groove (shown in FIG. 6*c*) allows condensate of the steam to flow from this region. It is believed that the accumulation of water, or the condensate of the steam, may further increase the probability of stress corrosion cracking in the wheel bore region, hence this slope and radial space substantially eliminates such accumulation. Also, these radial and circumferential spaces may provide openings for inspection devices to determine the presence of stress corrosion cracking indications. It is to be noted that the detailed description of the axially aft member 128 and slot 132 hereinabove is directly applicable to a member positioned at an axially fore location, as illustrated in FIGS. 1, 2, and 3. The primary difference between the axially aft member and the axially fore member is that the former protrudes radially inward beyond the inner surface of its hub section whereas the latter has its radial extent limited by the radial dimension of the inner surface.

Figure 7:
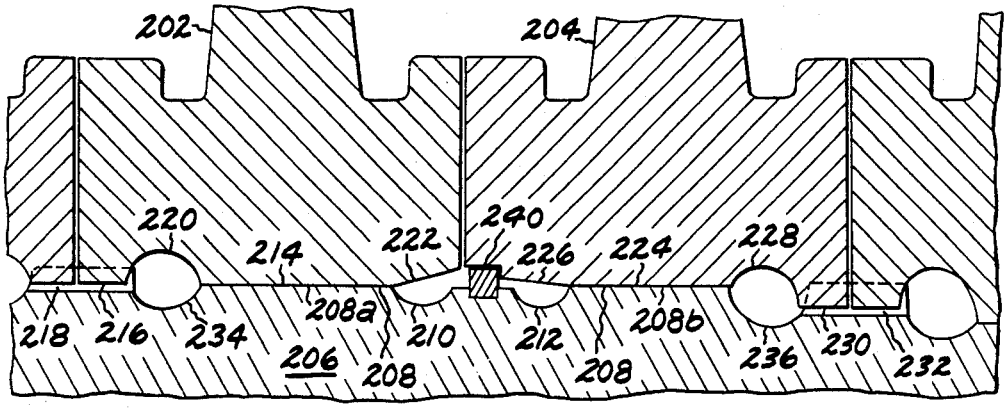
FIG. 7 illustrates a partial, cutaway longitudinal view of the hub sections of several turbine wheels wherein a pair of wheels are secured to one accommodating sequential step.

FIG. 7 illustrates a pair of wheels and their associated hub sections 202 and 204 secured to shaft 206 by an interference shrink fit. The accommodating sequential step surface 208 has a substantially uniform radial dimension throughout its axial span. Surface 208 has two axially separated step portions 208*a* and 208*b*. A pair of parallel circumferential grooves 210 and 212 segregate axially fore step portion 208*a* and axially aft step portion 208*b*. Axially fore hub section 202 is secured to shaft 206 by interference fit at the interface between inner surface 214 and step surface 208*a*. Hub section 202 has an axially fore member 216 which matingly engages a longitudinal slot 218 on the preceeding step having a greater radial dimension than accommodating step 208. Hub section 202 has an axially fore shoulder 220, from which protrudes member 216, and an axially aft shoulder 222.

Hub section 204 is secured to shaft 206 by interference fit at the interface between inner surface 224 and step portion 208*b*. The hub section has a fore shoulder 226 and an aft shoulder 228 from which protrudes an aft member 230. Member 230 matingly engages longitudinal slot 232 on accommodating step surface 208. Fore groove 234 and aft groove 236 of accommodating surface 208 operate in similar manner as fore and aft grooves of the other sequential steps described herein. Step surface 208 includes grooves 210 and 212, which provide relief between the two interference fit interfaces of step 208, and the grooves are radially aligned with facing shoulder portions 222 and 226. Additionally illustrated in FIG. 7 is an axial ring 240 which mates with a cut out portion of shoulder 226 of hub section 204 to prevent axial movement of hub section 204 as well as hub section 202 on shaft 206.

FIG. 7 and the accompanying description illustrates that both fore and aft members can be utilized to prevent rotation of the wheels relative to the shaft if a particular wheel's interference fit should loosen. In a like manner, a particular wheel could utilize a finger as described and illustrated in FIG. 2 axially protruding from the axially fore end face of hub section 40. In this manner, each finger would matingly engage the slot in the preceeding step's surface. One skilled in the art could utilize a combination of fingers and radially protruding members without departing from the scope of this invention.

Figure 8:
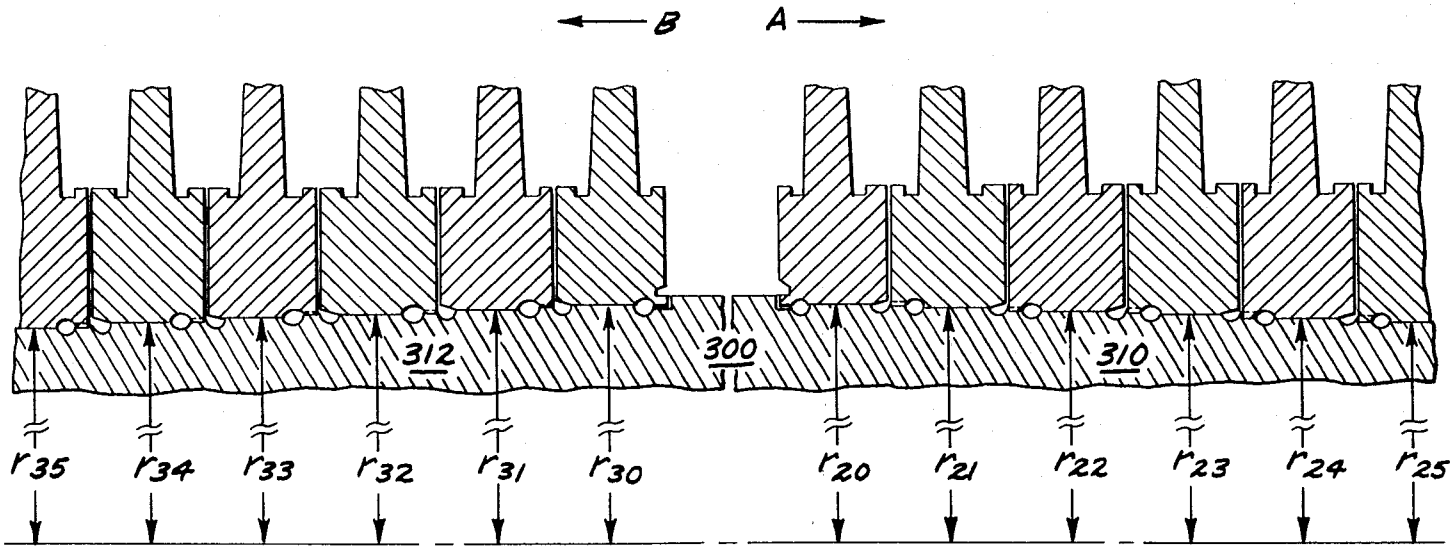
FIG. 8 illustrates a partial, cutaway view of the turbine rotor for a double flow turbine and shows the rotor having two axial segments, each having a set of sequentially decreasing steps.

FIG. 8 illustrates a partial cut away longitudinal view of a double flow turbine rotor. As is recognized in the art, a double flow turbine has steam flowing in two axially opposite directions generally illustrated by arrows A and B in FIG. 8. The multi-stepped shaft 300 has two axial segments, segment 310 on the right hand side of FIG. 8, and segment 312 on the left hand side of FIG. 8. Each axial segment has a plurality of steps having sequentially decreasing radii. As illustrated, axial segment 310 has a largest step surface at radius $r_{20}$, the next step surface at lesser radius $r_{21}$ and other step surfaces sequentially decreasing from $r_{22}$ through $r_{25}$. In a similar manner, axial segment 312 has a set of steps which have sequentially decreasing radii beginning with the largest step having a radial dimension of $r_{30}$ and with decreasingly smaller steps having dimensions ranging from $r_{31}$ through $r_{35}$. The construction of the rotor, hubs, members etc. illustrated in FIG. 8 is substantially similar to that illustrated and described in relationship to other Figures. The distinguishing feature to be noted in FIG. 8 is that the rotor has two sets of steps, each having sequentially decreasing radii, extending outward from a maximum radial portion of shaft 300. In this embodiment, the terms axially "fore" and "aft" refer from the perspective of the maximum radial portion of the shaft.

The description of a particular hub section having one type of member or finger as a safety, antirotation means and the adjacent hub section having a similar member or finger is not meant to limit the scope of the invention because adjacent hub sections could utilize a different type of member and/or finger. This is generally described in relation to FIG. 7. The important feature of this invention relates to the location of a discrete member or finger on the shoulder, the location of a discrete arcuate, substantially circumferential groove separating that member or finger from the interference fit interface, in combination with the relief grooves and the longitudinal slot on the shaft.

It is to be recognized that the members or fingers occupy only a discrete arcuate portion of the wheel bore. In one embodiment of this invention, two members are utilized as safety antirotation devices. Those two members are displaced substantially circumferentially opposite each other on the wheel bore. It is believed to maintain a minimum stress concentration factor at the wheel bore of the hub section, no more than four members or fingers should protrude from that bore.

A person of ordinary skill in the art could practice the invention with the principles described and illustrated herein. The appended claims are intended to cover all of the above modifications and devices which fall within the true spirit and scope of the present invention as disclosed herein.

We claim:

1. In a steam turbine, a rotor comprising:

a multi-stepped shaft rotatably mounted within said steam turbine, each step having a substantially uniform radius over its axial expanse and at least some of the steps having sequentially decreasing radii along an axial segment of said shaft from a maximum radial portion of said shaft;

each of the sequential steps having a step surface which includes a pair of substantially parallel circumferential grooves thereon, the axially fore groove is adjacent the preceeding step having a greater radius and the axially aft groove is axially spaced apart from but proximate to the next succeeding step having a lesser radius, each step surface having a longitudinal slot thereon axially extending between said aft groove and the axially aft edge of said step, and said slot having a depth less than that of said aft groove;

a plurality of wheels being associated with said sequential steps, at least one wheel of said plurality of wheels being secured to each sequential step by an interference shrink fit between the radially inner surface of the hub section of said one wheel and the corresponding step surface, said interference fit preventing rotation between said wheels and said shaft during normal steam turbine operations, and each wheel including, at its radially outermost portion, a plurality of steam turbine blades;

the hub section of said wheels having a shoulder portion at each axial end of said radially inner surface, said shoulder having a greater radial dimension than said inner surface, and said hub section having at least one discrete radially inward disposed member protruding from the shoulder at one axial end of said hub section, said member being axially spaced away from said inner surface by a discrete arcuate groove circumferentially oriented on said shoulder, said member being matingly engageable with the slot proximate said one axial end, and the member's leading face being in contact with the slot's leading side wall such that said member prevents rotation of said wheel relative to said shaft if said interference fit should loosen.

2. A rotor as in claim 1 wherein the interfaces between the member's leading and trailing faces and said shoulder are streamlined fillets such that the stress concentration factor in the region of said member is lower than the concentration factor for interfaces having simple circular fillets.

3. A rotor as in claim 2 wherein each of said wheels is secured to and corresponds to a separate sequential step, and said member is disposed at the axially fore end of said hub section and does not protrude radially beyond said inner surface, and the shoulder adjacent said member is matingly engageable with the axially aft portion of the preceeding step which portion includes said aft groove, and said member is matingly engageable with said slot on said preceeding step surface.

4. A rotor as in claim 3 wherein said shaft includes a radially extending integral flange disposed proximate the sequential step corresponding to the wheel having the radially greatest bore through its hub section, said flange having a longitudinal slot thereon axially extending to the axially aft edge of said flange, the hub section of said greatest bore wheel having a shoulder portion at each axial end of its radially innner hub surface, said shoulder having a greater radial dimension than said inner surface, said hub section having at least one finger axially protruding from one of the axial end faces of said hub section proximate the adjacent shoulder, said adjacent shoulder having a discrete arcuate groove circumferentially oriented and axially spacing said finger from said inner surface, said finger being matingly engageable with said flange slot to prevent rotation of said greatest bore wheel with respect to said shaft if the interference fit between said inner surface and said corresponding step surface should loosen.

5. A rotor as in claim 2 wherein each of said wheels corresponds to a separate sequential step, and said member protrudes from the axially aft end of said inner surface radially beyond said inner surface and is matingly engageable with said slot on the step corresponding to said wheel.

6. A rotor as in claims 1, 4 or 5 further including a second discrete member displaced substantially circumferentially opposite the first member.

7. A rotor as in claim 1, 4 or 5 wherein one of the faces of said member is radially aligned with the adjacent end face of said hub section.

8. A rotor as in claim 1, 4 or 5 wherein the portion of said shoulder circumferentially beyond said discrete arcuate groove having an outbound angular slope between 0° and 10° as referenced from said step surface of said shaft.

9. A rotor as in claim 2 wherein a pair of wheels of said plurality of wheels is secured to one accommodating sequential step having a substantially uniform radial dimension, the accommodating step surface having two axially spaced apart step portions which are separated by a pair of parallel and circumferential grooves in addition to said axially fore and aft grooves, the axially fore wheel, adjacent the preceeding sequential step of greater radial extent, having its member disposed proximate its axially fore end of its hub section, the axially fore member being matingly engageable with the slot on said preceeding sequential step, and the axially aft wheel, adjacent the succeeding sequential step, having a member disposed proximate its axially aft end of its hub section, the axially aft member extending radially inward beyond said inner surface of the aft wheel's hub section and being matingly engageable with the slot on said accommodating step surface, and said axially fore wheel being secured to the axially fore step portion of said accommodating step and said axially aft wheel being secured to the axially aft step portion of said accommodating step by said interference fit and the shoulders of said axially fore wheel and said axially aft wheel which face each other are radially aligned with said pair of grooves separating said fore and aft step portions.

10. A rotor as in claim 2, 3 or 5 wherein said turbine is a double flow turbine having steam flow in two axially opposite directions and said multi-stepped shaft includes two axial segments, each said segment having a set of steps having sequentially decreasing radii, each set of steps extending axially from a maximum radial portion of said shaft disposed at an axially inboard position of said shaft, and the "axially fore" and "axially aft" references in the preceeding referenced claims are as viewed from the perspective of said maximum radial portion of said shaft.

11. In a steam turbine, a rotor comprising:

a multi-stepped shaft rotatably mounted within said steam turbine, each step having a substantially uniform radius over its axial expanse and at least some of the steps having sequentially decreasing radii along an axial segment of said shaft from a maximum radial portion of said shaft;

said shaft having a radially extending, integral flange disposed on said maximum radial portion of said shaft proximate the sequential step having the largest radius relative to the other sequential steps;

each of said sequential steps having a step surface which includes a pair of substantially parallel circumferential grooves thereon, the axially fore groove is adjacent the preceeding step having a greater radius and the axially fore groove of the radially greatest sequential step is adjacent said flange, the axially aft groove is axially spaced apart from but proximate the succeeding step having a lesser radius, each step surface having a longitudinal slot thereon axially extending between said aft groove and the axially aft edge of said step, and said slot having a depth which is less than the depth of said aft groove;

said flange having a longitudinal slot thereon axially extending to the aft edge of said flange;

a plurality of wheels being associated with said sequential steps, at least one wheel of said plurality of wheels being secured to each sequential step of said shaft by an interference shrink fit between the radially inner surface of the hub section of said wheel and the corresponding step surface, said interference fit preventing rotation between the wheel and said shaft during normal steam turbine operation, and each wheel including, at its radially outer most portions, a plurality of steam turbine blades;

the hub section of said wheel having a shoulder portion at each axial end of said inner surface, said shoulder having a greater radial dimension than said inner surface, and said hub section having at least one discrete finger axially protruding from the axially fore end face of said hub section adjacent the shoulder portion, said finger being axially spaced from said inner surface by a discrete arcuate groove circumferentially oriented on said shoulder, said finger being matingly engageable with the slot on said preceeding step surface, and the finger of the wheel disposed adjacent said flange being matingly engageable with the slot on said flange, the leading faces of said fingers being in contact with the leading side walls of said slots such that said fingers prevent rotation of said wheel relative to said shaft if said interference fit should loosen.

12. A rotor as in claim 11 wherein the interfaces between the leading and trailing faces of said fingers and the axially fore end faces of said hub sections are streamlined fillets.

13. A rotor as in claims 11 or 12 wherein a portion of said shoulder circumferentially beyond said discrete arcuate grooves having an outbound angular slope between 0° and 10° as reference from said step surface.

* * * * *